US005314395A

United States Patent [19]

Ciolino

[11] Patent Number: 5,314,395

[45] Date of Patent: * May 24, 1994

[54] AQUATIC REHABILITATION PLATFORM

[76] Inventor: Peter A. Ciolino, 561 Cherry Tree La., Kinnelon, N.J. 07405

[ * ] Notice: The portion of the term of this patent subsequent to Sep. 22, 2009 has been disclaimed.

[21] Appl. No.: 894,181

[22] Filed: Jun. 5, 1992

Related U.S. Application Data

[63] Continuation-in-part of Ser. No. 530,620, May 30, 1990, Pat. No. 5,149,314, which is a continuation-in-part of Ser. No. 359,215, May 31, 1989, abandoned.

[51] Int. Cl.[5] ..... A63B 21/008

[52] U.S. Cl. ..... 482/111; 482/142; 472/129; 5/481; 441/129; D21/237

[58] Field of Search ..... 482/55, 111, 142; 472/129; 5/481, 653, 922; 4/575.1; 434/254; 297/250, DIG. 3; 441/35, 60, 127, 129, 131; 128/25 R; D21/237

[56] References Cited

U.S. PATENT DOCUMENTS

| | | | |
|---|---|---|---|
| 1,587,605 | 6/1926 | Scroggins | 432/55 X |
| 2,623,574 | 12/1952 | Damsch | 441/129 X |
| 2,803,839 | 8/1957 | Mosley | 441/131 |
| 3,167,794 | 7/1965 | Brown | 441/127 X |
| 3,860,976 | 1/1975 | Suyama | 4/575.1 |
| 4,394,783 | 7/1983 | Simmons | 441/127 X |
| 4,687,452 | 8/1987 | Hull | 441/131 |
| 4,771,722 | 9/1988 | Tihany | 441/131 X |
| 4,858,913 | 8/1989 | Stuart | 482/55 |
| 5,149,314 | 9/1992 | Ciolino et al. | 482/111 |

*Primary Examiner*—Richard J. Apley
*Assistant Examiner*—J. Cheng
*Attorney, Agent, or Firm*—Hopgood, Calimafde, Kalil, Blaustein & Judlowe

[57] ABSTRACT

A flotation system to support rehabilitation of patients in an aquatic environment. The system includes a restriction pad to limit the level of flexing associated with select aquatic exercises and pathologies. In addition, the system includes two symmetrically opposed outriggers connected to the upper float section for increase stability during use along with a strapping system on all sections to decrease movement on the device.

The rehabilitation float system of the present invention permits patient access to aquatic based exercises even when the patient is handicapped or being rehabilitated from a significant and disabling trauma.

7 Claims, 2 Drawing Sheets

AQUATIC REHABILITATION PLATFORM

This is a continuation-in-part of application Ser. No. 07/530,620 filed on May 30, 1990, now U.S. Pat. No. 5,149,314, which is a continuation-in-part of application Ser. No. 07/359,215 field on May 31, 1989, now abandoned.

The present invention relates generally to flotation platforms for permitting aquatic based exercise routines for the handicapped and, more particularly, a flotation system engineered for the more demanding needs of rehabilitation based exercise routines.

BACKGROUND OF THE INVENTION

Although exercising is universally pursued, it takes on special importance in the field of the handicapped or rehabilitation, i.e., the effort to restore the motor skills to someone that has suffered a debilitating trauma of some sort. The techniques of rehabilitation are fast approaching a well defined science directed to addressing the specific needs of the patient in a manner analogous to the approach taken by a doctor when first prescribing treatment. Many different products have been developed to enable patients with impaired motor skills to focus on specific muscle groups in conditioning exercises.

Swimming has long been a favorite mechanism for rehabilitation mostly due to the low impact nature of the exercise. The muscle activities in swimming put little or no strain on the patients joints or limbs while providing a significant cardio-vascular workout.

There are several drawbacks to swimming as a means for rehab work. For many patients, swimming is difficult or impossible due to fear or no prior experience. Depending on the disability, swimming may involve too much strain or work for severely impaired patients. Also, swimming is unfocused; many rehab programs require a focused set of exercises directed to the deficient muscle groups.

The present invention provides a unique solution to these problems allowing a controlled set of exercise movements in a gravity free environment. Employing the aquatic exercise platform described in the above noted patent applications, the present invention includes several additions specifically contoured to the needs of rehab support. More specifically, the aquatic exercise platform is equipped with outriggers on either side to minimize the potential for platform flipping in the pool. In addition, a separate lumbosacral support pad is attached to the upper hinge section to provide a neutral position of the lumbosacral spine during a workout. Also, this support pad limits the degree of flexing for the hinge to a small and more manageable increment. Other enhancements include vest-like or strap attachments to the separate float sections providing a more secure support platform for the patient and decreasing the amount of controlled movement.

The above system is more fully understood by referring to the associated figures of which:

FIG. 1 provides a cross-sectional view of the present invention;

FIG. 2 provides a perspective plan view showing the position of the lumbosacral support pad; and FIG. 3 provides a plan view showing the position of the stabilizing outriggers.

FIG. 3A is a cross-sectional view taken from line 3A—3A in FIG. 3.

DETAILED DESCRIPTION OF THE INVENTION

As stated above, the present invention is based on the aquatic exercise platform that is the subject of the earlier patent application which has been incorporated by reference; no further discussion is presented on this aspect of the present system.

The rehab system focuses on three areas of enhancement. First, the degree of flexing associated with the first hinge in the exercise platform is restricted so that it is a fraction of its previous flexing range and that it provides an increase in resistance to the flexing. Second, the platform can be strapped onto the patient in a manner more associated with life saving float devices. This is to limit the amount of controlled movement and possibility of having the platform become separate from the patient in the water along with providing a more reassuring support to the patient. Third, the stability of the platform is enhanced by the inclusion of extension pontoons or outriggers. This restricts the potential for platform flipping during a workout, basically providing stability but also can be utilized for certain types of aquatic motion resistance.

Figure 1:
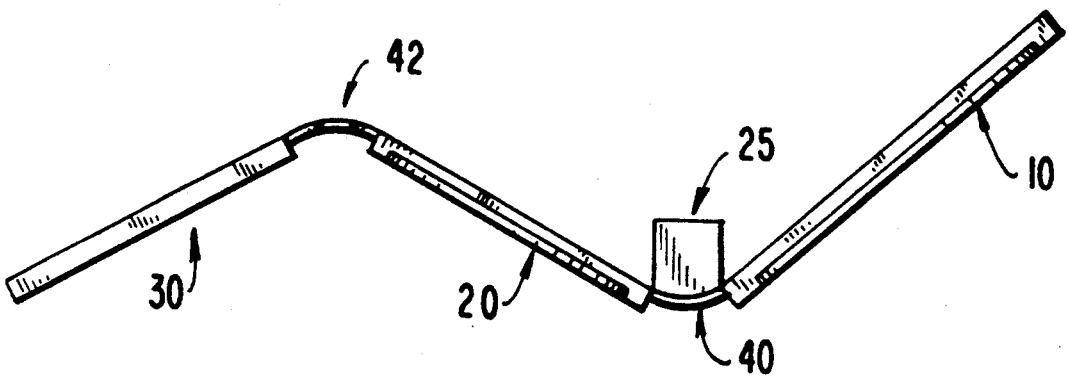

Turning now to FIG. 1, the floatation platform is shown in side view having three float sections; these sections are upper, 10, seat, 20 and lower, 30, interconnected by two hinges, i.e., upper hinge 40 and lower hinge 42. The lumbosacral support pad 25 is positioned on the upper hinge 40 and between the upper and seat float sections; this positioning restricts the flexing of the upper hinge to the range of 20 to 60 degrees or substantially less than the ninety degrees normally available with this hinge design.

Figure 2:
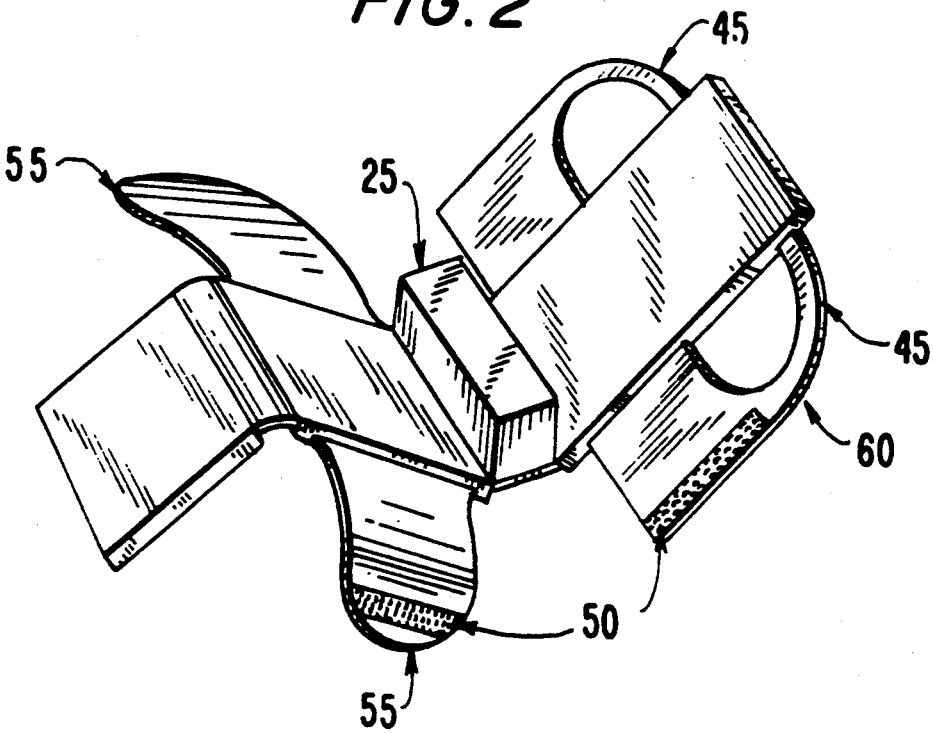

In FIG. 2, a perspective view is provided, wherein the position of the lumbosacral support pad 25 is shown as extending horizontally across the upper hinge 40. Alternately, upper and lower hinge flexion can also be reduced by decreasing the size of the hinge or putting stiffeners into the hinge. Lower hinge flexion can also be reduced by vertical strips bisecting the lower hinge area. In this figure, the vest-like wings are shown on both the upper and seat float sections. More particularly, a vest portion 45 is attached to each side of the upper float 10 with arm openings and VELCRO latching system for closing the vest. Similar flaps 55 are appended to each side of the seat float 20 with a VELCRO latch means 50. In this manner, the upper vest portion and lower seat flaps may be closed around the patient reducing the chance that the patient may become separated from the platform during use and also reducing the amount of movement and potential for tipping. In effect, these flaps when closed perform a seat-belt type function. Alternately, a plain strapping system 60 on each float section would be a more cost effective way of securing the patient to the float system along with reducing movement on the device. Various combinations of straps and vest supports will be used depending on the model and needs of the patient.

Figure 3:
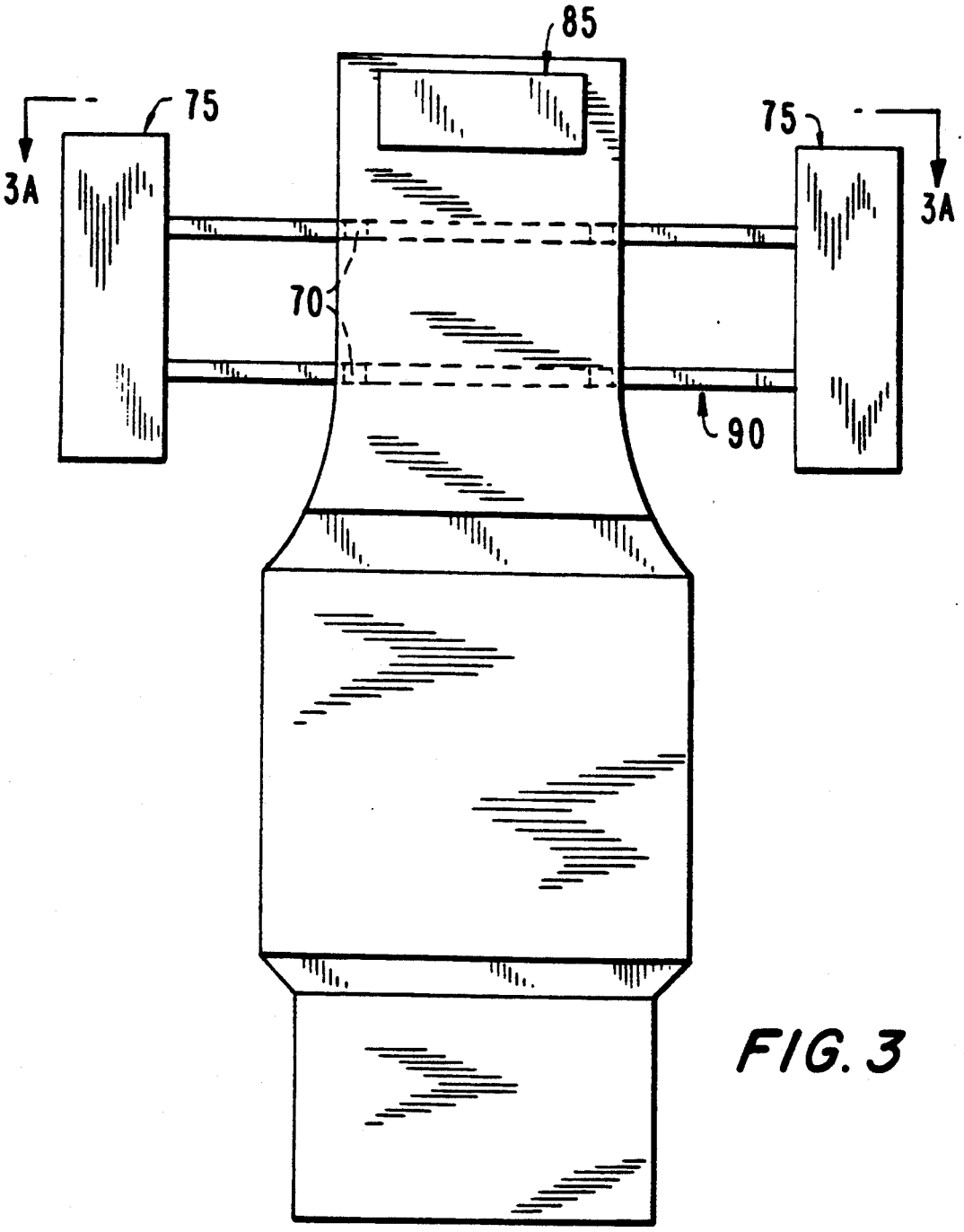
Figure 3A:
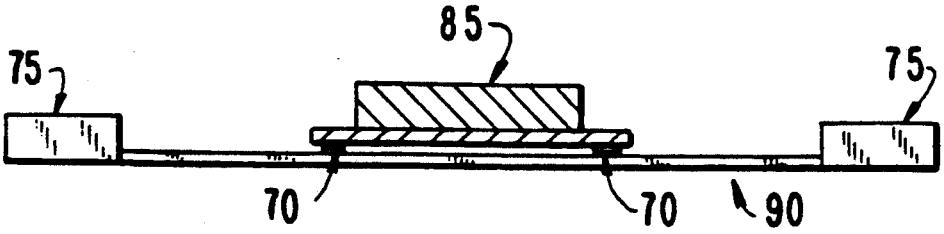

Turning now to FIG. 3, a plan view of the float system is shown highlighting the location of the stability pontoons on each side of the upper float section. More particularly, two semi-rigid spacer bars 90 run horizontally across the underside of the upper section and extending out to two pontoons 75, position in symmetrical locations relative to the upper float section. The pontoons are buoyant and can be made of gas filled polymers. Pontoons could also be removable attached via snaps 70 to each float section giving even further stability to the rehabilitation process. A cross-sectional view A—A is provided providing a frontal view of the upper float 10, the float pillow 85 and the pontoons 75 as connected to the float via spacer bars 90. Connection of the outriggers to the float sections can also be made by simple strap connectors with buckles. These would be used when no separate rigidity is required. The placement of the pontoons or outriggers is such that the overall stability of the float system is increased thereby reducing the possibility of capsizing during a rehab session.

Alternative pontoon shapes and buoyancy levels will of course be applied for patients with varying needs; for example, a person with chronic hip disorders will require larger pontoons than a person recuperating from knee surgery. The length of the aquatic exerciser may be adjusted by splitting the float section and hinge areas and allowing the sections and hinge areas to then be joined by a VELCRO fastening system.

The above-described arrangement is merely illustrative of the principles of the present invention. Numerous modifications and adaptations thereof will be readily apparent to those skilled in the art without departing from the spirit and scope of the present invention.

What is claimed is:

1. In combination in an apparatus to provide support and buoyancy to a user during a rehabilitation exercise routine performed in an aquatic environment comprising: a first flotation section configured and dimensioned to correspond to the shape of the user's back as extending from the upper shoulders to the waist of the user and having sufficient buoyancy to support the user's back at about the level of water in the aquatic environment, a second flotation section configured and dimensioned to correspond to the shape of the user's seat as made up of the buttocks to the upper thigh region of said user and having sufficient buoyancy to support said seat at about the level of water in said aquatic environment, and a first hinge means connecting said first flotation section with said second flotation section wherein said hinge means has restricted angle flexing and said first flotation section includes symmetrically positioned pontoons attached to said first flotation section for increased stability.

2. In combination in the apparatus of clam 1 wherein said flotation sections included retaining means for securing said user onto said apparatus.

3. In combination in the apparatus of claim 2 wherein said buoyant producing means comprises an air filled closed cell foam cushion.

4. In combination in the apparatus of claim 2 wherein said retaining means comprises straps anchored to opposing sides of said upper flotation section.

5. In combination in the apparatus of claim 1 further comprising a third flotation section structured and dimensioned to correspond to the user's lower legs and feet having sufficient buoyancy to support said user's lower legs and feet at about the level of the water of the aquatic environment, and a second hinge means connecting said third flotation section to said second flotation section in a position so that said flotation sections form a substantially elongated float conforming to the total length of said user.

6. In combination in the apparatus of claim 5, wherein said second hinge means is removably attached to said second flotation section.

7. In combination in the apparatus of claim 1, wherein the buoyancy of said flotation sections can be adjusted in accordance with a person's weight distribution.

* * * * *